United States Patent [19]

Oberg et al.

[11] 3,942,978

[45] Mar. 9, 1976

[54] METALLURGICAL METHOD

[75] Inventors: Karl-Erik Oberg; Lars-Gunnar Norberg, both of Hagfors, Sweden

[73] Assignee: Uddeholms Aktiebolag, Hagfors, Sweden

[22] Filed: Sept. 11, 1974

[21] Appl. No.: 505,171

[30] Foreign Application Priority Data

| | | |
|---|---|---|
| Nov. 28, 1973 | Sweden | 7316039 |
| Apr. 3, 1974 | Sweden | 7404473 |
| Apr. 3, 1974 | Sweden | 7404474 |
| May 22, 1974 | Sweden | 7406840 |
| June 14, 1974 | Sweden | 7407845 |

[52] U.S. Cl. ..... 75/51; 75/12; 75/52

[51] Int. Cl.[2] ..... C21C 7/00; C21C 5/52

[58] Field of Search ..... 75/51, 52, 60, 12

[56] References Cited

UNITED STATES PATENTS

| | | | |
|---|---|---|---|
| 2,502,259 | 3/1950 | Hulme | 75/51 |
| 2,593,505 | 4/1952 | Wagstaff | 75/51 |
| 3,010,820 | 11/1961 | Graef | 75/51 |
| 3,556,773 | 1/1971 | Grenfell | 75/51 |

*Primary Examiner*—Peter D. Rosenberg
*Attorney, Agent, or Firm*—Cushman, Darby & Cushman

[57] ABSTRACT

A process is provided for directly reducing a metal oxide to metal in a molten metal which comprises providing a body of molten metal in a converter provided with means for introducing molten metal and means for introducing metal oxide into the body of the molten metal by introducing molten metal therein, introducing said metal oxide as a powder suspended in a carrier gas, separately from said molten metal, into the body of the molten metal such that the molten metal introduced is hotter than the suspended powder and is distributed by said suspension to other parts of the mass of molten metal where the reduction can take place at the desired temperature. Preferably the molten metal is introduced into the converter via a channel in liquid communication with the converter, the channel opening into the converter at a level below the operating level of the molten metal, said metal being melted in a separate heating zone such that a temperature gradient is established between said zone and the contents of the converter, said zone having a refractory lining which is thinner than the lining of the converter, and the suspended metal oxide is injected into the body of the molten metal via a tuyere extending through the wall of the converter and terminating in the vessel at a distance from the channel, such that the suspended metal oxide does not pass through the heating zone.

11 Claims, 5 Drawing Figures

°C
%
"II, III"
Kg
1700
1600
1500
1400
1300
1200
1100
7
6
5
4
3
2
1
1400
1200
1000
800
600
400
200
°C
%Cr
II
III
%C
%Mn
%Sx10²
%Si
%Si
%Mn

°C
%
"I,II,III,IV"
Kg
1700
1600
1500
1400
1300
1200
1100
7
6
5
4
3
2
1
600
500
400
300
200
100
°C
IV
I
III
II
%W
%Si
%Cr
%Mn
%C

METALLURGICAL METHOD

This invention relates to a process for the direct reduction to metal of a metal oxide which is added to molten metal in a converter.

Numerous metallurgical processes exist which involve the injection into the molten metal of one or two phases which are emulsified and dispersed in a fluid matrix phase. One area in which such processes are particularly important is the so-called emulsion metallurgy. Processes in this area take advantage of the intimate contact between molten metal, solids and gas which can be obtained in fully dispersed systems and are particularly useful for iron and steel making and refining processes. Such processes in which suspensions of powders in fluid phases are introduced below the surface of the molten metal thus give greater reaction surfaces compared to processes in which the reactant to be introduced is placed on top of the melt.

Emulsion metallurgy is advantageously used for the reduction of metal oxide powders, for example the reduction of iron oxide powders for the production of crude iron, and/or for decarburisation purposes. One of the major problems in operating such processes is the maintenance of the temperature of the molten metal as the introduction of the metal oxide powder and the reactions between the oxide and the reduction agent, usually carbon, causes considerable temperature reduction in the metal. Of course, it is possible to use conventional heating means to heat the whole bulk of the metal being treated, for example in an arc furnace but such furnaces do not use electrical energy efficiently. Electrical induction heating makes much more efficient use of electrical energy than the electric arc furnaces but induction heating of the whole contents of a converter would require capital expenditure of a size that would be difficult to justify on an industrial scale. Moreover, the comparatively high electrical efficiency of induction heated vessels requires a thin lining of the vessel. A thin lining in a reaction vessel is, however, for practical reasons, not desirable due to the risk of damage caused by the wear on the lining during operation. On the other hand, if the thickness of the lining is increased, the high electrical efficiency will be lost.

We have now found that it is possible to take advantage of the benefits of electric induction heating without having to meet the problems of surrounding the whole converter with induction heating coils.

According to the present invention there is provided a process for directly reducing a metal oxide to metal in a molten metal which comprises providing a body of molten metal in a converter provided with means for introducing molten metal and means for introducing metal oxide into the body of the molten metal by introducing molten metal therein, introducing said metal oxide as a powder suspended in a carrier gas, separately from said molten metal, into the body of the molten metal such that the molten metal introduced is hotter than the suspended powder and is distributed by said suspension to other parts of the mass of molten metal where the reduction can take place at the desired temperature. Preferably the carrier gas contains 5 to 250 kg., more especially 30 to 150 kg., of metal oxide per cubic meter of gas (measured at normal temperature and pressure).

The process of the present invention is suitably used for the direct reduction of powdered oxidic iron ore concentrates by carbon to crude iron and/or steel. The process may also be used for the production of high grade steel, the oxide not necessarily being ion oxide, being at least partly one or more other metal oxides which can be reduced by carbon in the molten metal, the metals in question being introduced as alloying elements in the steel being produced.

It is a particular feature of the process of this invention that the cheapest raw materials can be used for the production of high grade steel or for the production of very pure steels, which have previously been produced according to the acidic open heart process or by electro-slag remelting. Further the present invention is particularly useful for the production of specialised high grade metallurgical products, for example tool steels, high speed steels, martensitic chromium steels, ball bearing steels, nickel steels for cryogenic purposes and silicon steels for electrical purposes. The process of this invention displays advantages at all steps in the production of stainless steels from the initial reduction of iron ore, for example, to the final decarburisation of a stainless steel melt. However, the process can also be combined with treatments other than reduction of metal oxides, in the converter or in other processing vessels, as in a process involving a plurality of steps.

The process of the present invention is suitably carried out in a converter which is provided with at least one projecting part with a channel in liquid communication with the converter vessel, said channel being provided with at least one heating zone separate from the vessel, the channel opening into the vessel at a level below the operating surface of the molten metal, said heating zone having a refractory lining which is considerably thinner than the lining of the vessel, and the contents of the zone being heated, suitably by electric induction heating, such that a temperature gradient is established between the contents of the zone and the contents of the converter. The exact dimensions of the heating zone are not critical, but it is desirable that only a relatively small part of the total weight of molten metal in the apparatus be located in the heating zone so that it can be heated to a temperature sufficient, above that of the main bulk of the molten metal to provide a sufficient temperature gradient to maintain or raise the bulk of the molten metal at, or to, the desired temperature.

To make it possible for the desired reduction processes effectively to take place in all parts of the vessel and to obtain maximum benefit of the temperature gradient, the metal oxide powder suspended in a carrier gas is preferably injected into the molten metal in the vessel through a tuyere extending through the lining of the vessel and terminating in the vessel at a distance from the channel opening, such that the solid metal oxide particles entrained in the suspension, substantially without entering the heating zone, cause the hotter metal outside the channel opening(s) rapidly to be distributed together with the metal oxide to various parts of the molten metal in the vessel where the desired reduction process can take place at the correct temperature. At the same time the transport of hot metal from the channel(s) will eliminate or at least substantially reduce the risk of solidification of the molten metal in the region of the tuyere.

We have found it convenient to utilise a heating zone which is part of a loop formed by a channel between two openings in the converter wall or bottom, the molten metal in the vessel interconnecting the two channel openings. Preferably the channel openings penetrate the vessel wall or bottom at the same level. It is also possible to operate with more than one loop or to use a simple extension of the main converter having a single liquid communication to the main converter. Whatever the exact physical form of the heating zone, it is advantageous to have the heating zone completely encircled by the induction heated windings.

The vessel and the heating means may otherwise be constructed in a conventional manner, both as regards design and dimensions. This means that the vessel should have a sufficient lining thickness to resist the severe wear during operation. Further the vessel should have a sufficient freeboard above the surface of the molten metal to allow for splashing and foaming of slag and metal during use. The freeboard height therein preferably is at least equal to the depth of the molten metal during operation. The converter is preferably tiltable in a manner such that the molten metal can be removed from the vessel without removing molten metal from the heating zone. The heating loop or other heating channel may be constructed according to the principles generally disclosed in "Elektrougnar och Induktiva Omrörare" (Chapter 5) 1969 by Yngve Sundberg. Ugnsbyrån, ASEA. Västerås, Sweden.

The present invention will now be illustrated, merely by way of example, with reference to the accompanying drawings, in which.

Figure 1:
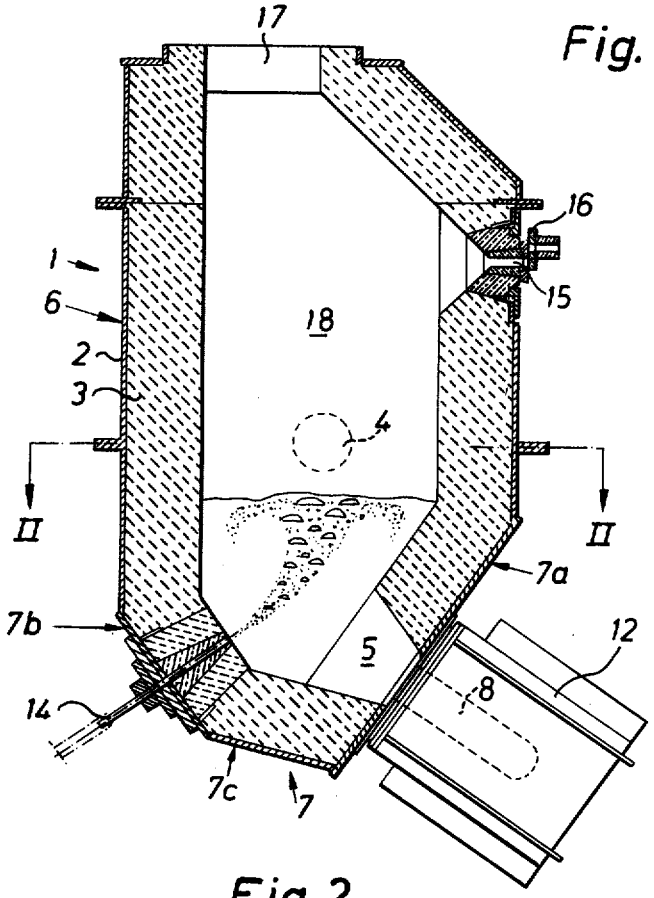
FIG. 1 shows a vertical cross-section through a converter suitable for carrying out the process of this invention.

The invention will now be explained in more detail with reference to FIGS. 1 and 2. A converter, generally designated 1, has side walls 6 comprising an inclined bottom portion 7*a* and, opposite to the bottom portion 7*a*, inclined bottom portions 7*b* and 7*c*. The converter itself comprises a steel casing 2 lined on the inside with a refractory lining 3. The thickness of the lining 3 is sufficient to resist wear during operation. Axle bars 4 are mounted in bearings (not shown) so that the converter can be tilted about an axis running through the axle bars 4. A melting channel 8 is provided at the lower end of the sloping bottom portion 7*a*, where the refractory lining has been removed to form a slightly conical recess 5 in the bottom portion 7*a*. Channel 8 forms a loop between two openings 9 and 10 into the main body of the converter in the region of the recess 5. Openings 9 and 10 are at the same level in the recess 5. The channel 8 is encircled by induction windings 12 for heating the contents of the channel 8. The channel has a refractory lining, (not shown) which is water cooled and considerably thinner than the lining 3 of the vessel to ensure high heating efficiency of the induction unit.

A tuyere 14 is located in the bottom portion 7*b* opposite the channel 8. The tuyere 14 opens perpendicularly to sloping bottom portion 7*b* and is directed towards the opposite bottom portion 7*a* where the recess 5 is provided. The vessel 1 is provided with a freeboard 18 above the surface of the molten metal to allow such splashing and foaming which is unavoidable during the performance of the metallurgic reactions. According to the embodiment shown in the drawings and freeboard has a height being about twice the depth of the molten metal during operation. A tap hole 15 is provided in the converter wall above the anticipated slag line and on the same side of the converter as loop 8. This tap hole may be kept closed with a slide gate 16 while the converter is operating. The top of the converter has a charging port 17.

A powder dispenser (not shown) fluidises the metal oxide powder to be introduced into the converter and a suspension of powder is then transported by the carrier gas and fluidising gas to tuyere 14. The fluidising gas herein can be of the same type as the carrier gas or be a different gas. It is also possible to use dispensers in which all the carrier gas is used to fluidise the metal oxide powder.

Figure 2:
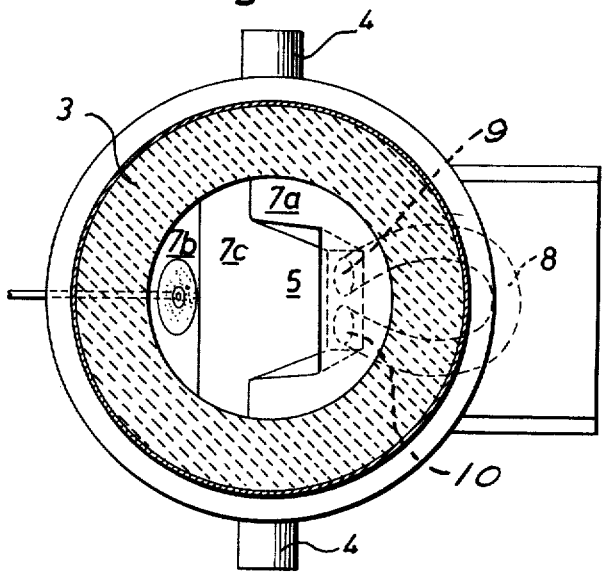
FIG. 2 shows the section II-II through the converter of FIG. 1.

Although the apparatus described above has a single loop it is possible to provide a converter with more than one loop of the type illustrated in FIGS. 1 and 2. Moreover, it is not essential that the induction heating zone be in the form of a loop with two channel endings at the converter wall; it can be a single induction heating zone having a single opening at the converter wall. It is also possible to provide more than one tuyere in the wall or bottom of the converter in combination with one or more channels which are conveniently arranged opposite the tuyere, such that at least one tuyere is directed towards each of the channels terminating in the converter wall or bottom. Normally, the heating loop 8 is kept filled with molten metal, it being maintained molten between the operating sequences, i.e. the loop is not emptied when the bulk of molten metal in the converter is tapped through tapping hole 15.

A typical sequence of operation is the following. An appropriate quantity of the molten metal is charged into the converter 1 through port 17. The temperature of the molten metal is measured, and if necessary for the desired reduction process, raised by adjusting the supply of electric power to the induction windings 12. When the desired temperature has been reached, the metal oxide power suspension is injected through tuyere 14. The tuyere 14 is aimed at the opposite bottom portion where the melting loop 8 is located; this, in combination with an adequate injection velocity, enables a quick replacement of the hotter metal in the recess 5, i.e. in the region outside the channel openings 9 and 10, substantially without any solid metal oxide particles from the tuyere entering the channel 8. Thus the hotter metal in the recess 5 outside the channel openings 9 and 10 will effectively be replaced by colder metal from other parts of the bulk of molten metal in the converter 1, which improves the exchange of heat between the channel 8 and the bulk of molten metal in the converter 1. Moreover, the metal oxide powder injected through the tuyere 14 together with the hot metal from the heating channel 8 is distributed rapidly throughout the body of molten metal in the converter, which is important for the kinetics of the desired reduction process and enables the reduction process between the metal oxide and a reduction agent to take place in all parts of the vessel at the correct temperature. A further advantage of the interaction between the hot metal from the heating channel 8 and the suspension which is injected through the tuyere 14 is that the metal from the heating channel 8 prevents the tuyere mouth from becoming clogged by metal solidifying by the cooling effect brought about by the injected suspension and protects the lining in the recess 5 so that the lining in the region of the channel openings is not eroded too quickly.

Usually the reducing agent taking part in the reduction process is carbon. The carbon may be dissolved from the start in the molten metal in the converter or be supplied successively during the operation. For instance carbon in the form of coal powder may be mixed with the metal oxide powder and injected with the oxide through the tuyere and/or be supplied on top of the molten metal.

When the reduction process or reduction processes are complete the injection of the metal oxide powder is stopped, and, after adjusting the chemical composition if necessary, the converter is tilted such that metal can be tapped through tap hole 15. Before tapping, the slag is usually removed through the port 17, continued blowing of air or other gas through the tuyere 14 facilitating the slag removal. Usually, molten metal is kept in the channel 8 and in the recess 5 so that the openings 9 and 10 of the channel are interconnected to form a closed loop. Before tapping, the molten metal may also be refined by vacuum treatment at the same time as metal oxide powder is injected through the tuyere 14. Other treatments such as known refining operations can, of course, be included.

Specific applications of the process of this invention will now be described in greater detail, although it will be appreciated that the principles are of general applicability.

PRODUCTION OF CRUDE IRON

Direct reduction of iron ore can be performed batchwise or continuously by the process of this invention. A batchwise process may be performed in a converter of the type described with reference to FIGS. 1 and 2 of the accompanying drawings. A typical processing sequence is the following. In the converter there is first charged a starting melt, preferably molten crude iron (pig iron), or molten steel. It is most convenient to use molten metal which is rich in carbon, generally at least 3% carbon (weight percent), in order to obtain a low liquidus point which is a precondition for a low processing (reduction) temperature which, in turn, is a prerequisite for very limited lining wear. The size of the starting melt is determined by the dimensions of the reaction vessel; the starting melt should be sufficiently deep in the vessel to make the desired reduction reaction possible using the best kinetic conditions which the process and equipment can offer.

Then the reduction is started by the injection of powdered iron ore concentrate into the molten metal in the converter through the tuyere 14 by means of a carrier gas. Additional iron ore can be supplied from above into the converter in the form of an agglomerate, e.g. in the form of pellets. Carbon is added to the molten metal in essentially stoichiometric amounts for the carrying out of the following reduction reaction:

$Fe_2O_3 + 3C \rightarrow 2\ Fe_{(l)} + 3CO_{(g)}$ (1), when the ore is hematite, and the reaction:

$Fe_3O_4 + 4C \rightarrow 3\ Fe_{(l)} + 4CO_{(g)}$ (2), when the ore is magnetite.

Mixtures of different ores may be used, in which case the carbon is supplied in an essentially stoichiometric amount relative to the combined ore concentrate so that all iron in the combined concentrate is liberated by reduction.

Carbon can be supplied in the form of a solid carbon material, such as graphite, coal products (anthracite and charcoal) and coke but also in the form of combustible carbonaceous compounds, such as fuel oil and gaseous hydrocarbons. Suitably, however, it is supplied in the form of coal, preferably coke. The coal can be supplied from above. It is also possible to introduce it into the melt via one or more separate tuyeres, which are not shown in the drawings. Suitably, however, a mixture of finely powdered ore concentrate and finely powdered carbon material is prepared in advance, the mixture containing at least stoichiometric quantities of carbon and ore for the reduction reaction. By mixing ore and coal in advance regulation problems are avoided. The mixture is blown in into the molten metal by means of the carrier gas through the tuyere 14. Additional carbon can be also supplied from above.

For economic reasons, air is most conveniently used as carrier gas for the reduction process. This requires an extra amount of carbon corresponding to the amount of oxygen present in the air introduced. Instead of air reducing gases may be used, for instance certain hydrocarbons, as well as inert gases such as argon. However, air is preferred.

The reduction process consumes large amounts of heat from the molten metal in the vessel. There is therefore a chance of a very quick temperature drop in the bulk of molten metal. Therefore the temperature is suitably maintained substantially constant during the reduction process by supplying sufficient electric energy to the induction windings 12 surrounding the channel 8. The hotter metal from the channel is forced out into the recess 5 from where it is brought into contact with the stream from the tuyere 14 and distributed to all parts of the vessel. In this manner the reduction process can take place in all parts of the molten metal at the desired temperature. Preferably in the process of this invention the temperature is kept at a level just above the liquidus temperature of the metal in the converter, more particularly from the liquidus temperature to 200°C., above that temperature, preferably not more than 100°C., above the liquidus temperature, by adjusting the supply of electric energy to the induction unit in the case of the apparatus of FIGS. 1 and 2. The injection of ore concentrate and coal is continued until the desired quantity of iron has been obtained. Thereafter the molten metal may, depending on the kind of lining, be refined with the elimination of sulphur by the injection of CaO or other desulphurising agents through the same tuyere 14 as has been used for the ore injection. Prior to casting, the temperature of the molten metal is generally raised to a suitable casting temperature by increasing the electric power supplied to the inductor connected to the heating channel 8.

PRODUCTION OF UNALLOYED STEELS

In the production of unalloyed steels according to the process of this invention the converter is first charged with a sufficient quantity of molten pig iron. Alternatively a sufficient quantity of crude iron is produced in situ in the converter according to the principles described above. The temperature of the molten metal is thereafter raised to about 1500°C., by means of the electric windings 12 surrounding the channel 8. Then iron ore powder is injected, entrained in air, through the tuyere 14. During the first injection period silicon and manganese are oxidised. Dependent on the temperature of the melt, a certain amount of carbon is simultaneously removed. When silicon and manganese have been oxidised, the slag is removed from the surface of the molten metal so that the main carbon decarburisation can start. In preferably a single step the melt is brought to the desired carbon content by means of iron oxide powder which is injected through the tuyere. Air usually is used as carrier gas. When the desired carbon content has been reached, the gas is switched from air to argon and necessary alloying additions are charged, usually from above. Argon is used only to ensure a rapid homogenisation of the melt. During the decarburisation the temperature is kept at the desired level by adjusting the power supplied to the electric windings 12. As the liquidus temperature of the metal depends on the carbon content in the molten iron-carbon alloy the temperature preferably should successively be increased such that the temperature is maintained from the liquidus temperature to 200°C., above that temperature, preferably from the liquidus temperature to 100°C., above the liquidus temperature.

It is also possible to use the equipment shown in FIGS. 1 and 2 for the melting of scrap iron in steel production according to the process of this invention. If the carbon content is too high when all the scrap iron has been melted the surplus carbon can be eliminated by the injection of powdered iron ore concentrate in the manner just described, keeping the temperature of the melt above the liquidus temperature.

EXAMPLE 1

Figure 3:
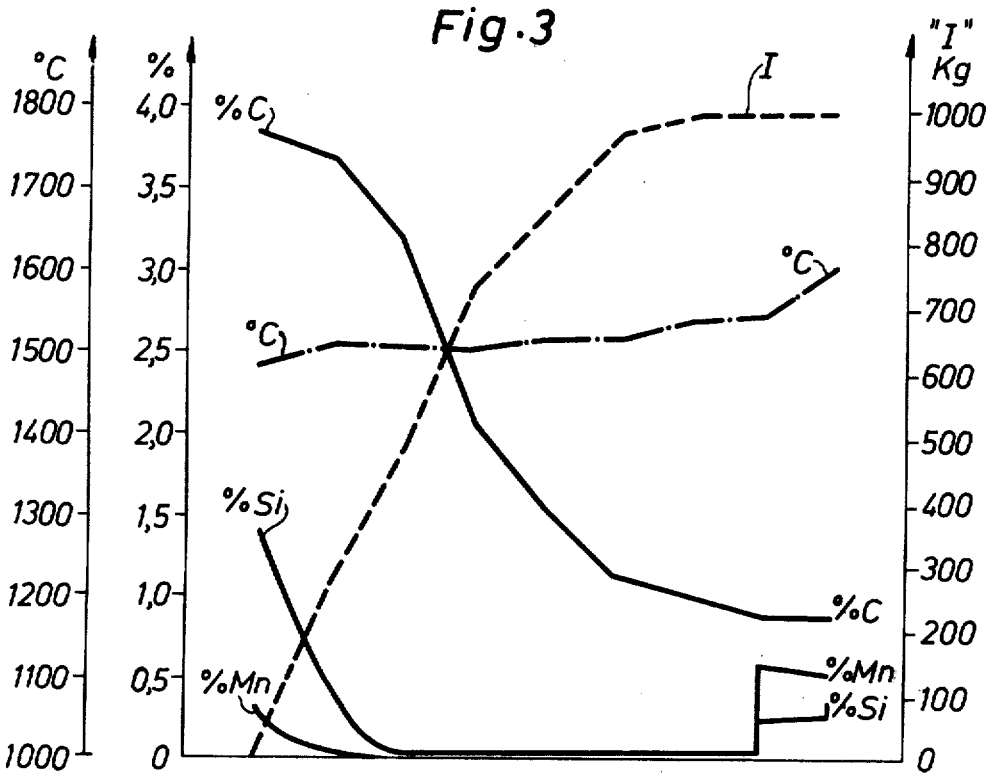
FIG. 3 is a diagram illustrating schematically the production of unalloyed steel.

An example will now be described with reference to the diagram shown in FIG. 3 illustrating decarburisation of pig iron according to the process of this invention. The converter shown in FIGS. 1 and 2 was charged with about 4.5 metric tons of molten pig iron. The space 5 and the channel 8 therebefore contained 800 kg. molten steel. The combined molten metal had the following approximate composition by weight:

3.8% C, 1.4% Si, 0.3% Mn. Balance iron and incidental impurities. A suspension of magnetite ore concentrate ($Fe_3O_4$) in air was injected through the tuyere 14. A total quantity of about 1,000 kg. $Fe_3O_4$ concentrate (about 90% $Fe_3O_4$) was introduced and emulsified in the molten pig iron in the converter. In the diagram in FIG. 3 curve I illustrates the accumulated ore concentrate injected during this period. The temperature curve shows how the temperature of the molten metal is raised during this injection period from about 1,480°C., to about 1,550°C. The other curves show how the contents of carbon, silicon and manganese change during the injection of the iron oxide. Thus during the initial period substantially all the silicon and manganese is oxidised and then the main decarburisation period apparently takes place. When 1,000 kg. ore concentrate have been injected, the carbon content has been reduced to about 1.0%. When the desired carbon level has been reached, manganese and silicon can be added to the molten metal from above and homogenised by the injection of argon through the tuyere 14. At the same time the temperature of the molten metal is raised to about 1,600°C., which is a suitable tapping temperature.

PRODUCTION OF ALLOYED STEELS

Steels containing chromium, for example 1 to 15% by weight chromium may be produced in the following manner. First there is charged an iron melt rich in carbon into a converter, for example that illustrated in FIGS. 1 and 2. As an alternative the iron melt is prepared in situ in the vessel as previously described. The temperature of the molten metal is raised by means of the induction windings 12 to a temperature of, for example, 1,600° to 1,750°C., preferably from 1,600° to 1,700°C. When the desired temperature has been reached there is injected through the tuyere 14 a suspension of an oxidic chromium ore concentrate suspended in air. The oxidic chromium ore is preferably chromite, i.e. an oxide of iron and chromium, FeO, $Cr_2O_3$. The powdered ore concentrate is distributed to all parts of the vessel bringing with it the hotter metal in the space 5 outside the channel openings 9 and 10. The temperature during this injection of chromite is suitably maintained in the temperature region 1,600° – 1,750°C., preferably 1,600° – 1,700°C., by regulating the power input to the electric windings 12. If the carbon content of the melt is sufficiently high the following reaction (3) will proceed:

$$Cr_2O_3 + 3C \rightarrow 2Cr_l + 3CO_g \quad (3)$$

For the production of medium chromium steels the carbon content should generally be at least 1% by weight during the injection of the chromium oxide. This means that extra carbon should be added to the melt if the carbon content is reduced to 1% by weight before the desired chromium content has been reached. It is also possible to add carbon during the chromium oxide injection, either from above or together with the oxide powder. Preferably the carbon content is maintained above 2% by weight during the reduction of chromium oxide by carbon. When the desired chromium content has been reached in the melt, the carbon content may be (further) reduced by injecting iron ore concentrate at the same time as the temperature is kept roughly constant in the bulk of molten metal.

EXAMPLE 2

Figure 4:
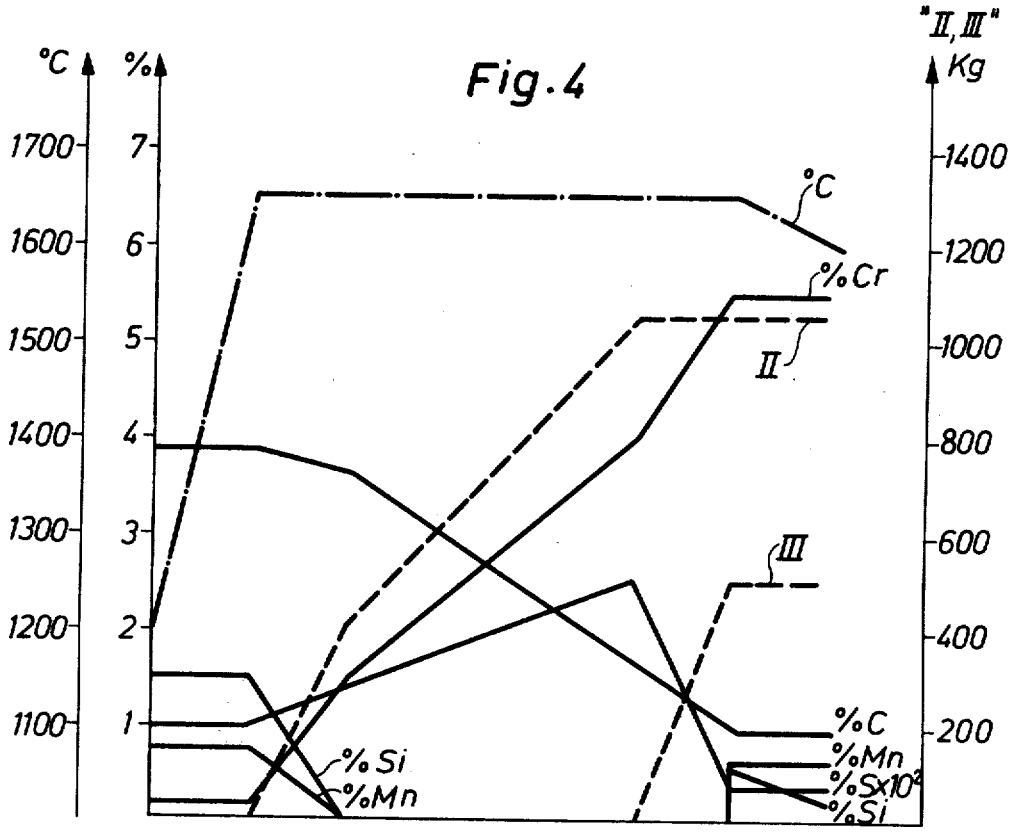
FIG. 4 is a diagram illustrating schematically the production of a tool steel containing chromium.

The diagram of FIG. 4 illustrates schematically an example of producing a medium chromium steel in the converter illustrated in FIGS. 1 and 2. In the converter there is first charged a pig iron which is mixed with the molten metal existing in the channel 8 and space 5, so that the combined metal has the following composition in weight per cent:

3.8% C, 1.6% Si, 0.8% Mn, 0.01% S. Balance iron and incidental impurities.

The temperature of this molten metal was first raised to about 1,650°C., by means of the electric windings 12. When this temperature had been reached, about 1,025 kg. chromite ore concentrate in the form of a powder, together with powdered lime as a slag forming agent entrained as a suspension in air was injected through the tuyere 14. Curve II in FIG. 4 shows the accumulated ore concentrate injected into the molten metal during this step. The temperature was maintained from 1,600° to 1.750°C., especially 1,600° – 1,700°C., during the whole of the chromite injection period. The injected powder contained about 47% by weight $Cr_2O_3$. The injection was interrupted when the carbon content had been reduced to 1% by weight. The chromium content in the molten metal then had been raised to about 5.5% by weight. At the same time the sulphur content has increased due to sulphur impurities in the chromite concentrate. In order to remove sulphur lime CaO, curve III in FIG. 4 was injected as is apparent. Finally the manganese and silicon contents were adjusted by the addition of these alloying elements from above, argon being injected through tuyere 14 to stir the melt in the vessel.

Stainless steel and other chromium alloys having chromium contents above 15% by weight may also be produced in a similar manner. However, stainless steel and other high chromium alloys are more conveniently prepared by first melting in a conventional manner in an electric arc furnace, and then the molten alloy having the desired chromium content is charged into a converter of the type illustrated in FIGS. 1 and 2, where the alloy is decarburised. For this decarburisation there is used iron oxide or other metal oxide which is easier to reduce than chromium oxide, e.g. nickel oxide, NiO. This decarburisation can be performed by the injection of the powdered oxide in a carrier gas through the tuyere 14. In this case the temperature is preferably maintained at 1,600° to 1,750°C., preferably 1,600° to 1,700°C., by controlling the electric power supplied to the induction windings 12. For the injection air is preferably used as a carrier gas until the carbon content has been reduced to about 1% by weight. Thereafter argon and/or steam is preferably used as carrier gas instead of air in order to avoid take up of nitrogen in the molten steel. In order to obtain low carbon contents without oxidation of chromium the concentration of argon and/or steam should be kept high. It is also possible to blow high concentrations of a diluting gas (argon and/or steam) at the same time as the atmosphere in the converter above the surface of the molten metal is evacuated by vacuum pumps while continuing the injection of ore concentrate. This combination of diluting gas treatment and vacuum decarburisation is preferably utilised for the production of so-called ELI-steels, i.e. steels having very low contents of carbon and nitrogen. Very low contents herein means a total quantity of not more than 0.03%, preferably not more than 0.015%, by weight of carbon and nitrogen (taken together). These steels often contain molybdenum as an alloying element. The decarburisation of the chromium containing molten metal is partly performed by the injection of powdered molybdenum oxide $MoO_3$. Also nickel oxide NiO can be used for this purpose.

PRODUCTION OF SPECIAL ALLOY STEELS — EXAMPLE 3

Figure 5:
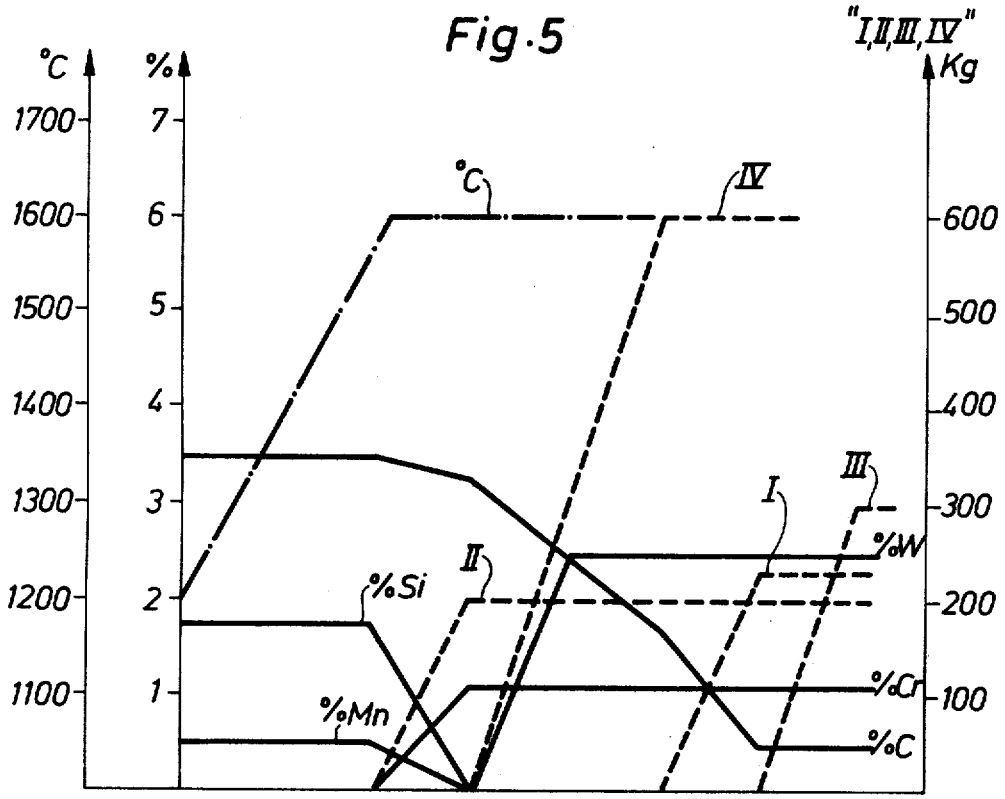
FIG. 5 is a diagram illustrating schematically the production of a low alloyed tool steel containing chromium and tungsten.

Referring now to FIG. 5 an example will be described illustrating the production of a special steel containing more than one alloying metal. According to the schematic diagram the molten metal used as starting material had a temperature of 1,200°C., and contained 3.5% C, 1.75% Si, 0.5% Mn. First the temperature of the molten metal is raised to 1,600°C., by means of the induction windings 12. When this temperature has been reached, about 200 kg. chromite concentrate, curve II, of the same kind as in the previous Example is injected into the converter at the same time as the temperature is maintained roughly constant. The chromium oxide in the injected chromite powder is reduced by silicon and manganese present in the melt and to some extent by carbon. Thus about 1.1% by weight chromium in the molten metal is obtained. Air was used as a carrier gas for the chromite powder. In the next step 600 kg. scheelite concentrate, curve IV in FIG. 5, is injected into the molten metal in the form of a powder entrained in air. Scheelite is a tungsten oxide ore; the concentrate injected into the molten metal contained about 32% by weight $WO_3$. The temperature was maintained constant during the scheelite injection by adjusting the electric power supplied to the electric windings 12. The tungsten ore is reduced by carbon present in the melt so that about 2.5% by weight tungsten is obtained in the melt. During this step the carbon content in the melt is reduced from about 2.25 to about 1.75% by weight carbon. To reduce the carbon content in the molten metal further there is injected about 225 kg. magnetite or concentrate, curve I. This ore concentrate was also injected by using air as a carrier gas. The injection was stopped when the carbon had reached the 0.5% level. The temperature was maintained constant at about 1,600°C., by supplying sufficient electric power to the induction windings 12. As a final step about 300 kg. CaO, curve III, is injected into the molten metal entrained in argon for the purpose of sulphur refining.

This Example illustrates two characteristic features of the method of the invention, namely when a special steel or other alloy contains more than one alloying metal, the metal oxides are injected stepwise, in the order corresponding to decreasing affinity for oxygen. This means that that oxide which is easiest to reduce by carbon or other reducing agent is injected in the last stage while the oxide which is most difficult to reduce is introduced in the first stage and other possible metal oxides are introduced therebetween according to their oxygen affinity. The example also illustrates that silicon and manganese existing in the starting melt may advantageously be used for the reduction of e.g. chromium oxide injected into the molten metal in the first stage of the process.

Another kind of alloyed steel which may be produced according to the process of this invention is steel for cryogenic (low temperature) purposes, e.g. 5% or 9% Ni-steels. Here an iron melt rich in carbon is produced and charged, for example into a converter of the kind illustrated in FIGS. 1 and 2. To this melt there is supplied NiO at the same time as the temperature is maintained at a desired temperature level by means of the induction heating unit such that the hot metal is transported to all parts of the molten metal by means of the stream of powder injected through the tuyere. The addition of Ni-ore concentrate is continued until the desired carbon and/or nickel content has been reached by the reaction between NiO and carbon dissolved in the melt, said carbon liberating metallic nickel through reaction with the oxygen in the nickel oxide.

Of course in all the cases described it is possible to introduce metal oxide not only through the tuyere in the form of a powder, but also to add metal oxide in the form of an agglomerate from above in the converter.

According to a further embodiment of this invention the decarburisation is carried out using a carrier gas preferably consisting of oxygen, a mixture of air and oxygen or a mixture of other gas and other oxygen. In this case oxygen may be responsible for the decarburisation while the metal oxide injected together with the gas will serve as a cooling agent and as a means for increasing the impulse of the injected gas-powder mixture.

We claim:

1. A process for the production of molten metal comprising directly reducing a reducible metal oxide to metal by reaction with a reducing agent present in a body of molten metal in a tiltable converter having, means for introducing the metal to be treated and means for removing the metal after treatment; at least one tuyere for introducing a gas/solid suspension into the converter at a level that will be below the surface of the molten metal when the converter is in its vertical operating position;

said converter having at least one heating zone spaced away from the converter, the heating zone having at least one channel in liquid communication with the converter, the channel opening into the converter at a level that will be below the surface of the molten metal when the converter is in its vertical operating position and essentially in the region of that point in the converter which is the deepest point when the converter is in its vertical operating position; said heating zone being filled with metal and having means for heating the contents of the zone by electric induction heating;

the process comprising introducing molten or unmolten metal into the converter, heating the metal in the heating zone by electric induction heating so that a body of molten metal is created in the converter and in the heating zone and a temperature gradient is established between the molten metal in the heating zone and the molten metal in the converter thereby forcing hotter metal from the heating zone out into the deepest region of the converter outside the channel opening:

fluidizing the metal oxide in the carrier gas to form a suspension and injecting the suspension containing at least 5kg. metal oxide per cubic meter of carrier gas (measured at normal temperature and pressure) into the body of molten metal in the converter through at least one of said tuyeres, directing the suspension towards that region of the converter where the heating channel is located so as to bring about replacement of the hotter metal in the deepest region of the converter outside the channel opening by colder metal from other parts of the converter;

controlling the reduction temperature by adjusting the supply of electric power to the induction heating means; removing slag from the body of molten metal whilst still retaining molten metal in the heating channel and then tapping molten metal from the converter.

2. A process according to claim 1, for the production of crude iron in which the metal oxide ia $Fe_2O_3$ or $Fe_3O_4$ or mixtures thereof and the carrier gas is air, the body of molten metal substantially consisting of molten iron, and essentially a stoichiometric amount of carbon is introduced into the molten metal so as to reduce the said iron oxide to molten iron.

3. A process according to claim 2, wherein the carbon is introduced in powder form in suspension with the metal oxide.

4. A process according to claim 1, for the production of iron alloys containing 1 – 15% by weight chromium in which the metal oxide comprises chromium oxide, the body of molten metal is molten iron or molten steel containing at least 1% by weight carbon dissolved therein, and the temperature is maintained during the chromium oxide injection period substantially within the range 1600° – 1750°C.

5. A process according to claim 4, in which the carbon is introduced in powder form in suspension with the metal oxide.

6. A process according to claim 4, wherein the reduction is carried out at 1600° – 1700°C.

7. A process according to claim 1, for the production of steel by decarburisation of molten crude iron or molten scrap iron containing carbon dissolved therein or a mixture thereof wherein the metal oxide is at least one oxide selected from the group consisting of $Fe_2O_3$, $Fe_3O_4$ and $Cr_2O_3$, the carbon dissolved in the molten metal reducing the metal oxide to molten metal, the temperature of the molten metal is maintained in the range from its melting point to 200°C above its melting point and the reduction process is continued until the desired carbon content has been achieved.

8. A process according to claim 7, for the production of unalloyed steels in which the metal oxide is $Fe_2O_3$ or $Fe_3O_4$ or a mixture thereof, the temperature of the molten iron is kept substantially within the temperature range 1480° to 1550°C during injection of the iron oxide and injection of the iron oxide is continued and the temperature maintained within the said temperature range until the desired carbon content has been reached.

9. A process according to claim 1, in which the suspension contains at least 30kg. metal oxide powder per cubic meter.

10. A process according to claim 7, in which, when the desired carbon content has been achieved, the temperature of the molten metal is raised to a temperature appropriate for tapping by supplying electric power to the induction heating means.

11. A process according to claim 1, in which injection of the suspension of metal oxide through the tuyere is stopped when the slag is removed from the converter.

* * * * *